US010431948B2

(12) United States Patent
Ashimura et al.

(10) Patent No.: US 10,431,948 B2
(45) Date of Patent: Oct. 1, 2019

(54) ROTARY CONNECTOR

(71) Applicant: AUPAC CO., LTD., Yamato (JP)

(72) Inventors: Shinya Ashimura, Yamato (JP); Satoru Baba, Yamato (JP)

(73) Assignee: AUPAC CO., LTD., Yamato (JP)

( * ) Notice: Subject to any disclaimer, the term of this patent is extended or adjusted under 35 U.S.C. 154(b) by 162 days.

(21) Appl. No.: 15/527,844

(22) PCT Filed: Feb. 4, 2016

(86) PCT No.: PCT/JP2016/053308
§ 371 (c)(1),
(2) Date: May 18, 2017

(87) PCT Pub. No.: WO2016/136414
PCT Pub. Date: Sep. 1, 2016

(65) Prior Publication Data

US 2017/0331241 A1 Nov. 16, 2017

(30) Foreign Application Priority Data

Feb. 24, 2015 (JP) ..... 2015-033672

(51) Int. Cl.
*H01R 39/26* (2006.01)
*H01R 3/08* (2006.01)
(Continued)

(52) U.S. Cl.
CPC ..... *H01R 39/26* (2013.01); *H01R 3/08* (2013.01); *H01R 39/30* (2013.01); *H01R 39/646* (2013.01); *H01R 39/025* (2013.01)

(58) Field of Classification Search
CPC ..... H01R 39/26; H01R 3/08; H01R 39/30; H01R 39/646; H01R 39/025; H01R 39/00; H01R 39/08
(Continued)

(56) References Cited

U.S. PATENT DOCUMENTS 4,188,523 A * 2/1980 Kawai ..... B23K 11/3045 219/83
4,433,229 A * 2/1984 Morikawa ..... H01R 39/646 219/119
(Continued)

FOREIGN PATENT DOCUMENTS

JP 60-013689 U 1/1985
JP 08-281415 A 10/1996
(Continued)

OTHER PUBLICATIONS

International Search Report dated Apr. 19, 2016, issued for PCT/JP2016/053308.

*Primary Examiner* — Naishadh N Desai
(74) *Attorney, Agent, or Firm* — Locke Lord LLP

(57) ABSTRACT

A rotary connector includes a rod-shaped rotating side electrode rotatably supported by an external shell case and a fixed side electrode supported by the external shell case. Rotating side electrode and the fixed side electrode are disposed so that one end parts of the electrodes face each other spaced apart to form a clearance therebetween, the rotary connector further has a cylindrical liquid impregnated member, disposed so as to surround the outer peripheral surface close to the one end part of the fixed side electrode, that covers the clearance formed between the fixed side electrode and the rotating side electrode from outer peripheral sides of the fixed side electrode and the rotating side electrode, and the region formed by one end part of the rotating side electrode, one end part of the fixed side electrode, and the inner peripheral surface of the liquid impregnated member is filled with liquid metal.

5 Claims, 13 Drawing Sheets

(51) Int. Cl.
*H01R 39/30* (2006.01)
*H01R 39/64* (2006.01)
*H01R 39/02* (2006.01)

(58) Field of Classification Search
USPC ..... 310/143, 147, 219–253
See application file for complete search history.

(56) References Cited

U.S. PATENT DOCUMENTS

| | | | | |
|---|---|---|---|---|
| 6,608,490 | B1 | 8/2003 | Tombini | |
| 2007/0013258 | A1* | 1/2007 | Kobayashi | H01R 39/22 310/251 |
| 2007/0152533 | A1* | 7/2007 | Hsu | H01R 39/20 310/248 |

FOREIGN PATENT DOCUMENTS

| | | | |
|---|---|---|---|
| JP | 10-210712 | A | 8/1998 |
| JP | 2002-536658 | A | 10/2002 |
| JP | 2012-099376 | A | 5/2012 |

* cited by examiner

ROTARY CONNECTOR

TECHNICAL FIELD

The present invention relates to a rotary connector for exchanging electric power or signals between the rotating side and the fixed side.

BACKGROUND ART

Conventionally, connectors (slip ring and rotary connector) for rotary connection have been used as electric mechanical components for exchanging electric power and signals between the rotating side and the fixed side. For example, PTL 1 proposes a slip ring, which is a connector for rotary connection. This slip ring performs energization between the rotating side and the fixed side by making the brush (carbon brush or metal brush) electrically connected to a fixed side mechanism slidable contact with the metal ring electrically connected to a rotating side mechanism.

Specifically, the slip ring described in PTL 1 includes a shaft like a hollow pipe rotatably supported via a bearing in the case of the main body, a collector, configured by alternately laminating collector rings (metal rings) and insulated rings, that is provided integrally and concentrically with the shaft, and a plurality of brushes that is provided so as to correspond to the collector rings, has individual base parts integrally supported by the case of the main body, and has end parts making slidable contact with the peripheral surfaces of the collector rings.

CITATION LIST

Patent Literature

PTL 1: JP-A-2012-99376

SUMMARY OF INVENTION

Technical Problem

In the prior art (slip ring described in PTL 1) described above, since the brushes make point contact with the metal rings in a slidable manner, there is a technical problem that the amount of resistance heat is large during energization. As a result, the sliding part of the above slip ring is easy to wear and has low durability (the sliding part (metal ring and brush) needs to be replaced periodically).

In addition, in the structure of the prior art described above, the sliding of the brushes may become unstable when the brushes pass on micro gaps formed in the surface of the metal ring, thereby causing a technical problem that conduction becomes unstable. In addition, unstable sliding of the brushes causes signal error and wear of the sliding part.

The invention addresses the above problems with an object of providing a rotary connector that reduces maintenance loads and stabilizes conduction.

Solution to Problem

The invention for solving the above technical problems is a rotary connector including a rod-shaped rotating side electrode rotatably supported by an external shell case and a fixed side electrode supported by the external shell case, in which the rotating side electrode and the fixed side electrode are disposed so that one end parts of the electrodes face each other spaced apart to forma clearance therebetween, a conductive part is provided between the one end part of the rotating side electrode and the one end part of the fixed side electrode, the conductive part making electrical connection between the rotating side electrode and the fixed side electrode, and the conductive part includes liquid metal and either multivalent alcohol or high viscosity oil.

Preferably, the rotary connector further includes a cylindrical liquid impregnated member disposed so as to surround an outer peripheral surface close to the one end part of the fixed side electrode, the liquid impregnated member covering a clearance formed between the fixed side electrode and the rotating side electrode from outer peripheral sides of the fixed side electrode and the rotating side electrode, in which the conductive part includes the liquid metal filling a region formed by the one end part of the rotating side electrode, the one end part of the fixed side electrode, and an inner peripheral surface of the liquid impregnated member and either the multivalent alcohol or the high viscosity oil with which the liquid impregnated member is impregnated.

As described above, in the rotary connector according to the invention, the rotating side electrode and the fixed side electrode are disposed so that one end parts of the electrodes face each other spaced apart to form a clearance therebetween. In addition, the conductive part for making electrical connection between the rotating side electrode and the fixed side electrode is provided between one end part of the rotating side electrode and one end part of the fixed side electrode and the conductive part includes liquid metal and either multivalent alcohol or high viscosity oil. In this structure, low and stable contact resistance is obtained between both electrodes and stable energization is achieved between both electrodes.

In addition, the component (brush) of the fixed side electrode according to the invention is not directly connected to the component (rotating rotary ring) of the rotating side electrode unlike the prior art and both electrodes are electrically connected to each other via the conductive part formed by liquid metal and either multivalent alcohol or high viscosity oil and wear and friction between components is reduced. Therefore, maintenance loads are reduced as compared with the prior art.

In addition, since both electrodes are electrically connected via the conductive part formed by liquid metal and either multivalent alcohol or high viscosity oil in the invention, sliding of the brushes is not made unstable by effects of micro gaps formed on the metal ring surface unlike the slip ring of the prior art. Accordingly, the invention improves the reliability of conductivity as compared with the prior art described above and occurrence of signal error is prevented.

In addition, the invention adopts the structure in which the liquid impregnated member forming the region to be filled with liquid metal is impregnated with multivalent alcohol or high viscosity oil. This structure is adopted because of the following reasons.

Specifically, as a result of the study of a rotary connector that reduces maintenance loads and stabilizes conductivity by the inventor of the application, he came to the conclusion that intervention of liquid metal between the rotating side electrode and the fixed side electrode is very effective. However, liquid metal is very easy to oxidize at the part in contact with air, so an oxidation film is formed in the part of the surface in contact with air. Therefore, when liquid metal filled between the rotating side electrode and the fixed side electrode is in contact with air, if the liquid metal is agitated by the rotation of the rotating side electrode, the entire liquid metal oxidizes and eventually becomes semi-solid and the conductivity between the electrodes becomes unstable. As a result of various attempts by the inventor of the application to prevent the oxidization of liquid metal between the electrodes, he found that oxidization can be effectively prevented when liquid metal is present in multivalent alcohol (or high viscosity oil). Accordingly, the inventor of the application thought the use of a liquid impregnated member (felt or sponge) impregnated with multivalent alcohol (or high viscosity oil) as a component for blocking the space formed between the rotating side electrode and fixed side electrode and completed the rotary connector having the above structure. As a result of the operation check of the rotary connector having the above structure, good results could be obtained in that liquid metal was not oxidized and conductivity was stable even for long time use.

As described above, according to the invention, it is possible to provide a rotary connector that prevents oxidization of liquid metal and achieves stable energization between the rotating side electrode and the fixed side electrode even when liquid metal is present between these electrodes.

In addition, preferably, the rotary connector may further include a first fluorocarbon resin ring fitted onto the outer peripheral surface close to the one end part of the fixed side electrode and a second fluorocarbon resin ring fitted onto an outer peripheral surface close to one end part of the rotating side electrode, in which one end part of the first fluorocarbon resin ring projects closer to the rotating side electrode than the one end part of the fixed side electrode, and the liquid impregnated member is fitted onto an outer peripheral surface of the first fluorocarbon resin ring so as not to make contact with the rotating side electrode, the liquid impregnated member slidably making contact with one end part of the second fluorocarbon resin ring, the one end part being fitted onto the outer peripheral surface of the rotating side electrode.

The reason why the first fluorocarbon resin ring is provided as described above will be described below. Specifically, when the rotating side electrode rotates, liquid metal moves toward the outer periphery of the rotating side electrode (and the fixed side electrode) due to the effects of the centrifugal force caused by the rotation and liquid metal is unevenly distributed to the outer periphery of the rotating side electrode (and the fixed side electrode), possibly causing reduction in the stability of electric connection. Therefore, the first fluorocarbon resin ring projecting closer to the rotating side electrode than one end part of the fixed side electrode is fitted onto the outer peripheral surface of the fixed side electrode to suppress the movement of liquid metal toward the outer peripheral part of the rotating side electrode (and the fixed side electrode) and prevent liquid metal from being unevenly distributed to the outer peripheral side of the rotating side electrode (and the fixed side electrode). This ensures stable energization between the electrodes.

In addition, in the invention, the liquid impregnated member is fitted onto the outer peripheral surface of the first fluorocarbon resin ring so as not to make contact with the rotating side electrode and one end part thereof makes slidable contact with one end part of the second fluorocarbon resin ring fitted onto the outer peripheral surface of the rotating side electrode. In this structure, since the liquid impregnated member does not make contact with the rotating side electrode that is rotating and makes slidable contact with the second fluorocarbon resin ring having low abrasion while the rotating side electrode rotates, wear of the liquid impregnated member is suppressed and loads during rotation can be reduced.

Preferably, the liquid metal is alloy of gallium, indium, and tin.

The reason why the above structure is adopted is that alloy of gallium, indium, and tin is not an environmentally hazardous substance such as mercury and the use of the alloy is not limited.

In addition, the invention is a rotary connector including a rod-shaped rotating side electrode rotatably supported by an external shell case and a fixed side electrode supported by the external shell case, the rotary connector including a first fluorocarbon resin ring mounted to one end part of the fixed side electrode, a second fluorocarbon resin ring fitted onto an outer peripheral surface close to one end part of the rotating side electrode, a cylindrical liquid impregnated member disposed between the first fluorocarbon resin ring and the second fluorocarbon resin ring so as to surround an outer peripheral surface of the first fluorocarbon resin ring and an outer peripheral surface of the second fluorocarbon resin ring, in which the rotating side electrode and the fixed side electrode are disposed so that the one end parts of the electrodes face each other spaced apart to form a clearance therebetween, the first fluorocarbon resin ring surrounds the clearance formed between the one end part of the fixed side electrode and the one end part of the rotating side electrode and surrounds an outer peripheral surface of the rotating side electrode so as not to make contact with the outer peripheral surface of the rotating side electrode, one end part of the second fluorocarbon resin ring and one end part of the first fluorocarbon resin ring face each other spaced apart to form a clearance therebetween, the liquid impregnated member is impregnated with multivalent alcohol or high viscosity oil, liquid metal fills a region formed by the one end part of the fixed side electrode, the one end part of the rotating side electrode, an inner peripheral surface and the one end part of the first fluorocarbon resin ring, the one end part of the second fluorocarbon resin ring, and an inner peripheral surface of the liquid impregnated member, and the liquid impregnated member slidably makes contact with the outer peripheral surface of the second fluorocarbon resin ring having an inner peripheral surface fitted onto the outer peripheral surface of the rotating side electrode.

Advantageous Effects of Invention

According to the invention, it is possible to provide a rotary connector for reducing maintenance loads and stabilizing conduction.

DESCRIPTION OF EMBODIMENTS

Embodiments (first embodiment, second embodiment, and third embodiment) of the invention will be described below with reference to the drawings.

Figure 1:
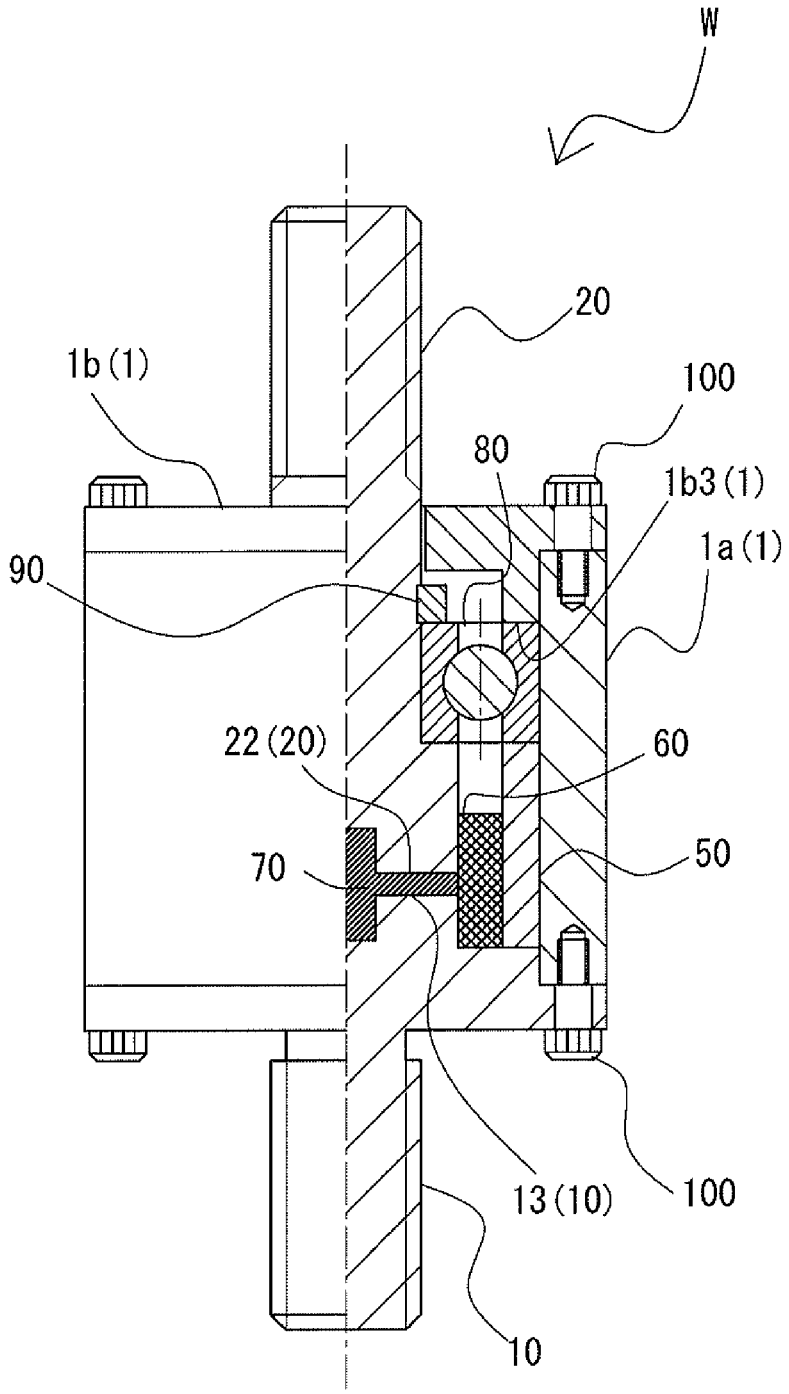
FIG. 1 is a schematic view used to describe the entire structure of a rotary connector according to a first embodiment of the invention.

First, the schematic structure of a rotary connector W according to the first embodiment of the invention will be described with reference to FIG. 1. FIG. 1 is a schematic view used to describe the entire structure of the rotary connector according to the first embodiment of the invention.

As illustrated in the drawing, the rotary connector W according to the first embodiment includes an external shell case 1, a fixed side electrode 10 mounted to the external shell case 1, a substantially rod-shaped rotating side electrode 20 rotatably supported by the external shell case 1, and a cylindrical felt (liquid impregnated member) 60 provided across the fixed side electrode 10 and the rotating side electrode 20 so as to surround the outer peripheral surface of the fixed side electrode 10 and the outer peripheral surface of the rotating side electrode 20.

The fixed side electrode 10 and the rotating side electrode 20 are disposed so that the end surfaces of one end parts of the electrodes face each other spaced apart to form a clearance therebetween. In addition, a felt 60 is attached to the inner peripheral surface of a cylindrical collar 50 so as to cover the clearance formed between the fixed side electrode 10 and the rotating side electrode 20 from the outer periphery sides of the fixed side electrode 10 and the rotating side electrode 20.

The external shell case 1 includes a main body unit 1*a* like a hollow cylinder having pierced ends and an upper lid 1*b*, which is circular in plan view.

In addition, the felt 60 is disposed so that the inner peripheral surface close to one end makes slidable contact with the outer peripheral surface close to one end part of the rotating side electrode 20 and the inner peripheral surface close to the other end makes contact with the outer peripheral surface close to one end part of the fixed side electrode 10. In this structure, the clearance formed between the fixed side electrode 10 and the rotating side electrode 20 is blocked by the felt 60 and a closed region (void) is formed by one end part of the fixed side electrode 10, one end part of the rotating side electrode 20, and the inner peripheral surface of the felt 60. In addition, the region formed by one end part of the fixed side electrode 10, one end part of the rotating side electrode 20, and the inner peripheral surface of the felt 60 is filled with liquid metal 70.

In the first embodiment, the liquid metal 70 is alloy of gallium, indium, and tin (the alloy of gallium, indium, and tin may be, for example, galinstan).

In addition, in the first embodiment, the felt 60 is impregnated with multivalent alcohol or high viscosity oil. In this structure, the conductive part (conductive part formed by the liquid metal 70 and either multivalent alcohol or high viscosity oil) for electrically connecting the fixed side electrode 10 and the rotating side electrode 20 is formed between one end part of the fixed side electrode 10 and one end part of the rotating side electrode 20. In addition, the structure in which the felt 60 is impregnated with multivalent alcohol or high viscosity oil achieves stable conductivity between both electrodes by preventing oxidation of the liquid metal 70 that is easily oxidized by air.

The multivalent alcohol or high viscosity oil may be, for example, glycerin.

As described above, in the rotary connector W according to the first embodiment, electrical connection between both electrodes is made via the liquid metal 70 instead of direct contact between both electrodes. Accordingly, consumption of components can be prevented as compared with the prior art described above and maintenance loads can be reduced significantly.

In addition, since electrical connection between both electrodes is made via the liquid metal 70 in the rotary connector W according to the first embodiment, effects of micro gaps or the like formed in the metal ring surface do not make the sliding of a brush unstable unlike the slip ring of the prior art. Accordingly, the reliability of conductivity is improved as compared with the prior art described above in the first embodiment and occurrence of signal error can be prevented. The components of the first embodiment will be described in detail below.

Figure 2:
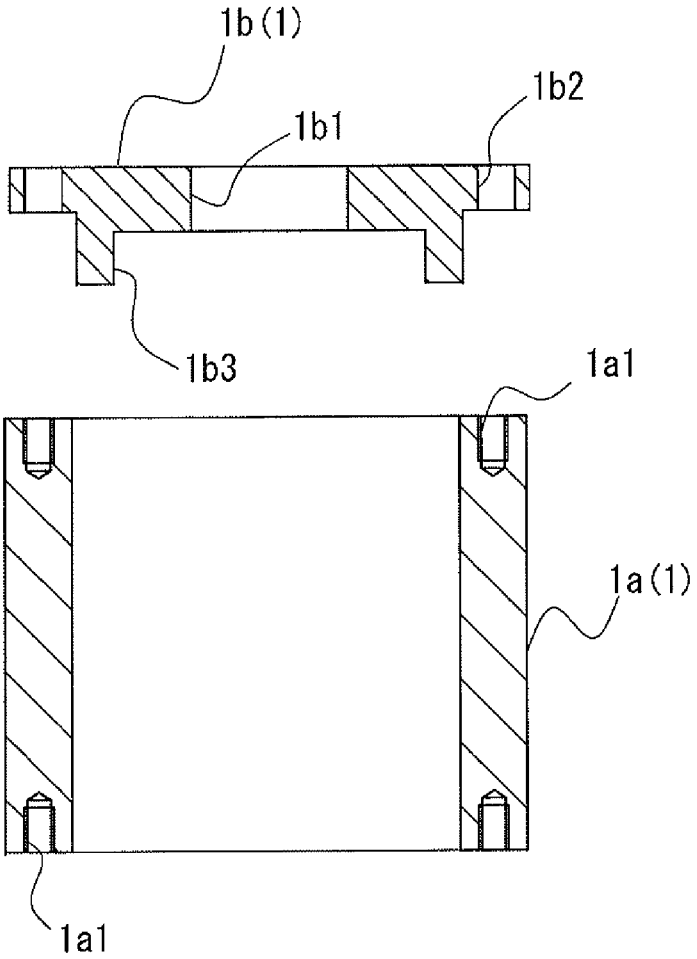
FIG. 2 is a schematic view illustrating a cross section of an external shell case of the rotary connector according to the first embodiment of the invention.

First, the structure of the external shell case 1 will be described with reference to FIG. 2. FIG. 2 is a schematic view illustrating a cross section of the external shell case of the rotary connector according to the first embodiment of the invention.

As illustrated in the drawing, in the main body unit 1*a* included in the external shell case 1, each of both ends of the cylindrical part is provided with screw holes 1*a*1. The screw holes 1*a*1 in the upper end are screwed with screws 100 for fixing the upper lid 1*b* and the screw holes 1*a*1 of a lower end part 1*b* are screwed with the screws 100 for fixing the fixed side electrode 10.

In addition, in the upper lid 1*b* included in the external shell case 1, the central part, which is circular in plan view, is provided with a through hole 1*b*1 into which a terminal part 21 of the rotating side electrode 20 is inserted and a screw hole 1*b*2 is formed in the vicinity of the outer peripheral edge. In addition, an annular convex part 1*b*3 projecting downward is formed on the lower surface (lower surface illustrated in FIG. 2) of the upper lid 1*b*. This annular convex part 1*b*3 and the cylindrical collar 50 hold a ball bearing 80 supporting the rotating side electrode 20 (see FIG. 1). The diameter (outer diameter) of the main body unit 1*a* is the same as the diameter of the upper lid 1*b*.

The external shell case 1 is made of metal, synthetic resin, or the like.

Figure 3:
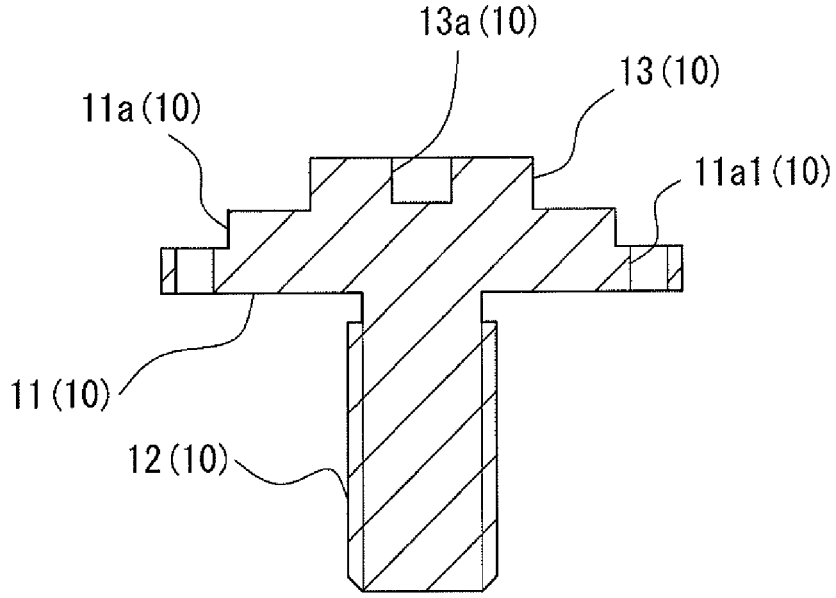
FIG. 3 is a schematic view illustrating a cross section of a fixed side electrode of the rotary connector according to the first embodiment of the invention.

Next, the structure of the fixed side electrode 10 will be described with reference to FIG. 3. FIG. 3 is a schematic view illustrating a cross section of the fixed side electrode of the rotary connector according to the first embodiment of the invention.

As illustrated in the drawing, the fixed side electrode 10 includes a base part 11 (discoid base part 11) that is circular in plan view, a substantially cylindrical convex part 13 projecting in one direction (upward in the drawing) vertically from one surface of the base part 11 (upper surface in the drawing) and the substantially cylindrical terminal part 12 extending in the other direction (downward in the drawing) vertically from the other surface (lower surface in the drawing) of the base part 11. A fixed side mechanism (not illustrated) is electrically connected to the terminal part 12.

The diameter of the base part 11 is the same as the outer diameter of the main body unit 1*a* included in the external shell case 1.

In addition, a step part 11*a* (annular in plan view) recessed like an L-shape in cross sectional view is formed on the outer peripheral edge of the base part 11. This step part 11*a* is fitted to the inner peripheral surface close to the lower part of the main body unit 1*a* of the external shell case 1. In addition, a screw hole 11*a*1 for fixation to the main body unit 1*a* of the external shell case 1 is formed in the step part 11*a*. In addition, a recessed concave part 13*a*, which is circular in plane view, is formed at the center of the convex part 13.

The fixed side electrode 10 is made of a conductive material such as metal.

Figure 4:
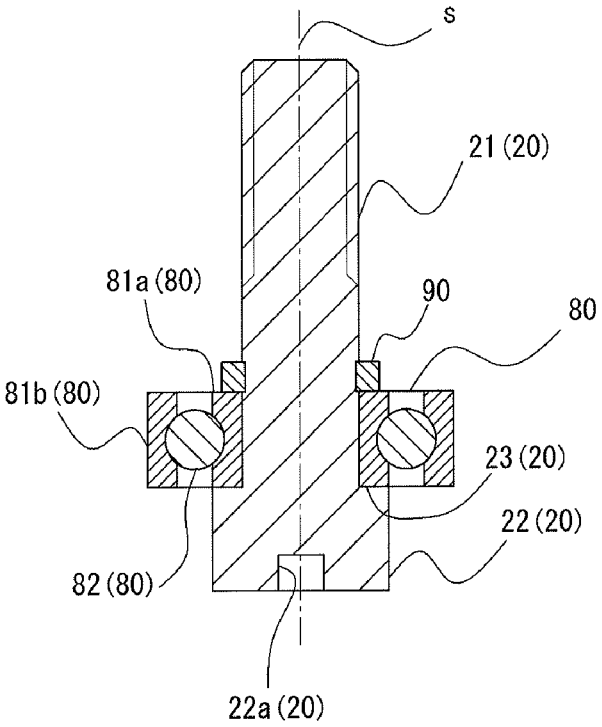
FIG. 4 is a schematic view illustrating cross sections of a rotating side electrode and a ball bearing of the rotary connector according to the first embodiment of the invention.

Next, the structure of the rotating side electrode 20 will be described with reference to FIG. 4. FIG. 4 is a schematic view illustrating cross sections of the rotating side electrode and the ball bearing of the rotary connector according to the first embodiment of the invention.

As illustrated in the drawing, one side (upper side in the drawing) of the substantially rod-shaped rotating side electrode 20 is the substantially cylindrical terminal part 21 and the other side (lower side in the drawing) is a substantially cylindrical large-diameter part 22 having a diameter larger than in the terminal part 21. A rotating side mechanism (not illustrated) is connected to the terminal part 21.

The diameter of the terminal part 21 is smaller than the diameter of the through hole 1*b*1 formed in the upper lid 1*b* of the external shell case 1. In addition, the diameter of the large-diameter part 22 is the same as the diameter of the convex part 13 of the fixed side electrode 10.

In addition, in the rotating side electrode 20, a step part 23 is formed on the border between the large-diameter part 22 and the terminal part 21. The ball bearing 80 is fixed to the step part 23 so that the rotating side electrode 20 is rotatably supported by the ball bearing 80. In addition, a recessed concave part 22*a*, which is circular in plan view, is formed at the center of one end part of the large-diameter part 22 and the concave part 22*a* faces the concave part 13*a* formed in the convex part 13 of the fixed side electrode 10 (see FIG. 1). In the first embodiment, the concave part 22*a* and the concave part 13*a* have the same size and the same shape.

The rotating side electrode 20 is made of a conductive material such as metal.

In addition, the ball bearing 80 includes an inner ring 81*a* having an inner ring track with an arc-shaped concave cross section, an outer ring 81*b* having an outer ring track with an arc-shaped concave cross section, and a plurality of balls 82 rotatably provided between the inner ring track and the outer ring track. In the ball bearing 80, the inner peripheral surface of the inner ring 81*a* is fitted onto and fixed to the outer peripheral surface of the terminal part 21 of the rotating side electrode 2. Specifically, in the ball bearing 80, the lower end part of the inner ring 81*a* is placed on the step part 23 of the rotating side electrode 20 and the upper end part of the inner ring 81*a* is fixed to a fixed side electrode 21 by a bearing fixing ring 90 fitted onto the outer peripheral surface of the rotating side electrode 20.

The ball bearing 80 is made of metal.

Figure 5:
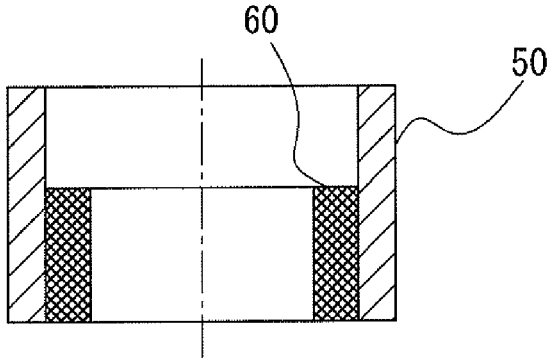
FIG. 5 is a schematic view illustrating cross sections of a felt and a cylindrical collar of the rotary connector according to the first embodiment of the invention.

Next, the felt 60 and the cylindrical collar 50 supporting the felt 60 will be described with reference to FIG. 5. FIG. 5 is a schematic view illustrating the cross sections of the felt and the cylindrical collar of the rotary connector according to the first embodiment of the invention.

Both the cylindrical collar 50 and the felt 60 are formed in hollow cylinders having pierced ends. In addition, the outer diameter of the felt 60 is slightly smaller than the inner diameter of the cylindrical collar 50 and the height of the felt 60 is smaller than the height of the cylindrical collar 50. The outer peripheral surface of the felt 60 is fitted to and fixed to the inner peripheral surface of the cylindrical collar 50 (the felt 60 is supported by the cylindrical collar 50).

The outer diameter of the cylindrical collar 50 is slightly smaller than the inner diameter of the main body unit 1*a* of the external shell case 1 and the outer peripheral surface of the cylindrical collar 50 is fitted to and fixed to the inner peripheral surface of the main body unit 1*a* of the external shell case 1.

Although the cylindrical collar 50 may be made of, for example, polyurethane or metal, it is preferably made of metal in terms of heat resistance. When using the cylindrical collar 50 made of metal, the cylindrical collar 50 is not degraded by heat caused by energization even under use conditions in which, the current flowing between electrodes exceeds, for example, 200 A.

In addition, the felt 60 retains multivalent alcohol (or high viscosity oil) and prevents the liquid metal 70 from flowing to other than the part between both electrodes. The inner diameter of the felt 60 is slightly larger than the outer diameter of the large-diameter part 22 of the rotating side electrode 20 (and the convex part 13 of the fixed side electrode 10). The inner peripheral surface of the felt 60 makes slidable contact with the outer peripheral surface of the large-diameter part 22 of the rotating side electrode 20 and makes contact with the outer peripheral surface of the convex part 13 of the fixed side electrode 10. The felt 60 is impregnated with multivalent alcohol or high viscosity oil as described above.

The individual components configured as described above are assembled as described below to form the rotary connector W according to the first embodiment.

Figure 6:
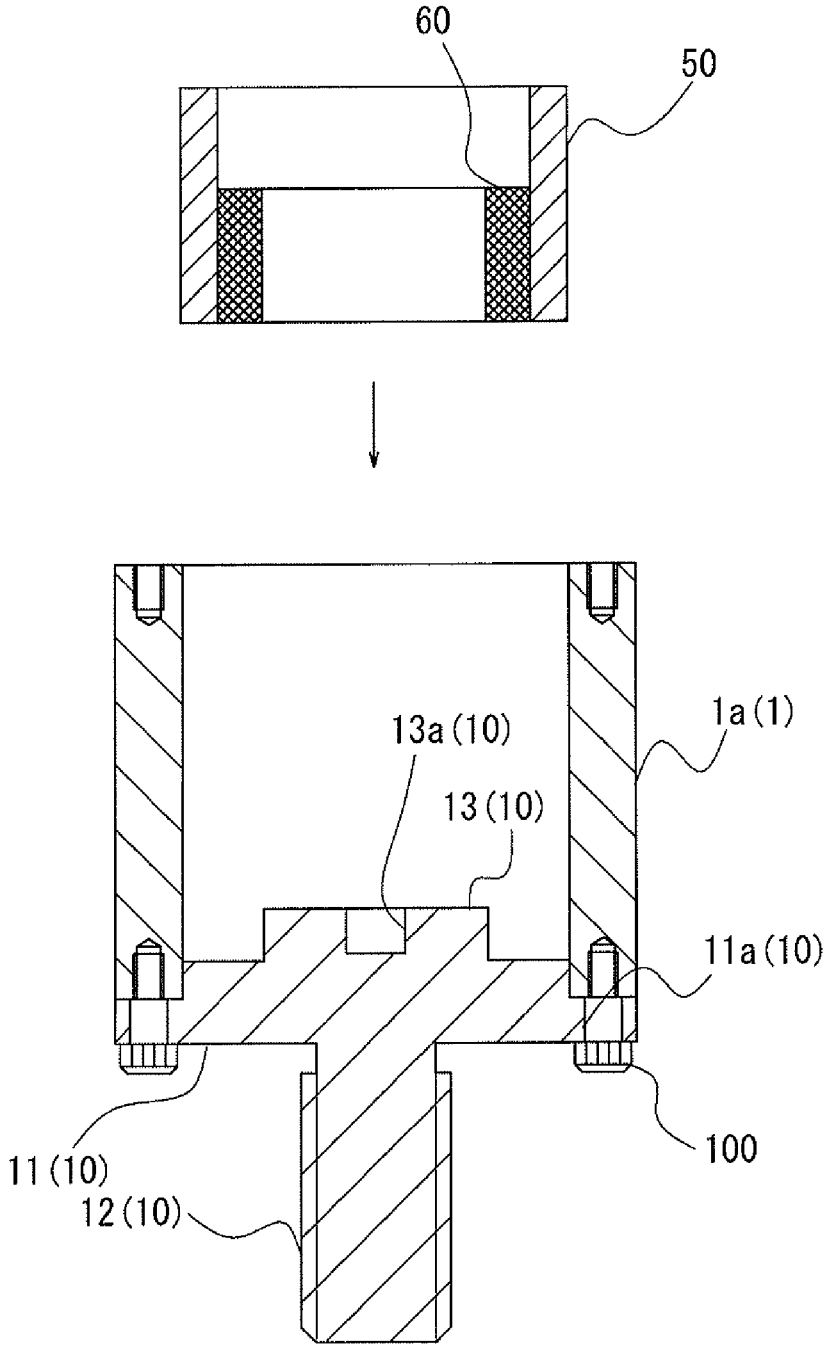
FIG. 6 is a schematic view used to describe an assembly process of the rotary connector according to the first embodiment of the invention.
Figure 7:
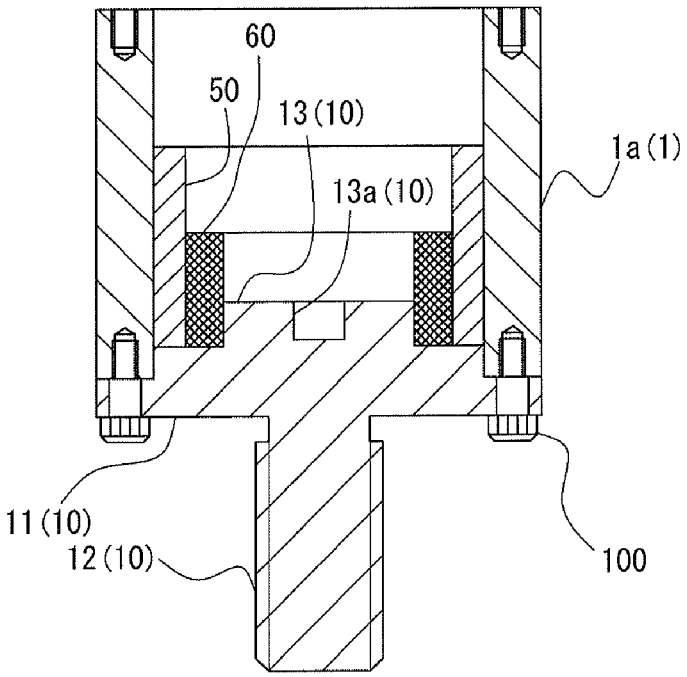
FIG. 7 is a schematic view used to describe the assembly process of the rotary connector according to the first embodiment of the invention.
Figure 8:
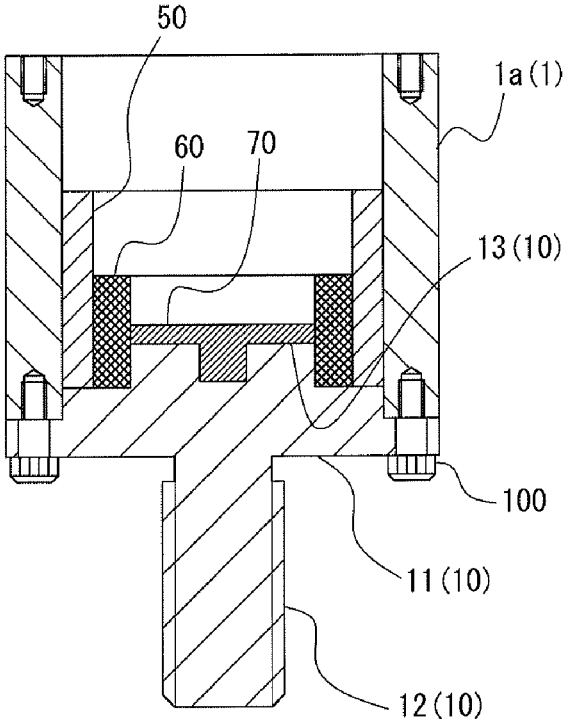
FIG. 8 is a schematic view used to describe the assembly process of the rotary connector according to the first embodiment of the invention.
Figure 9:
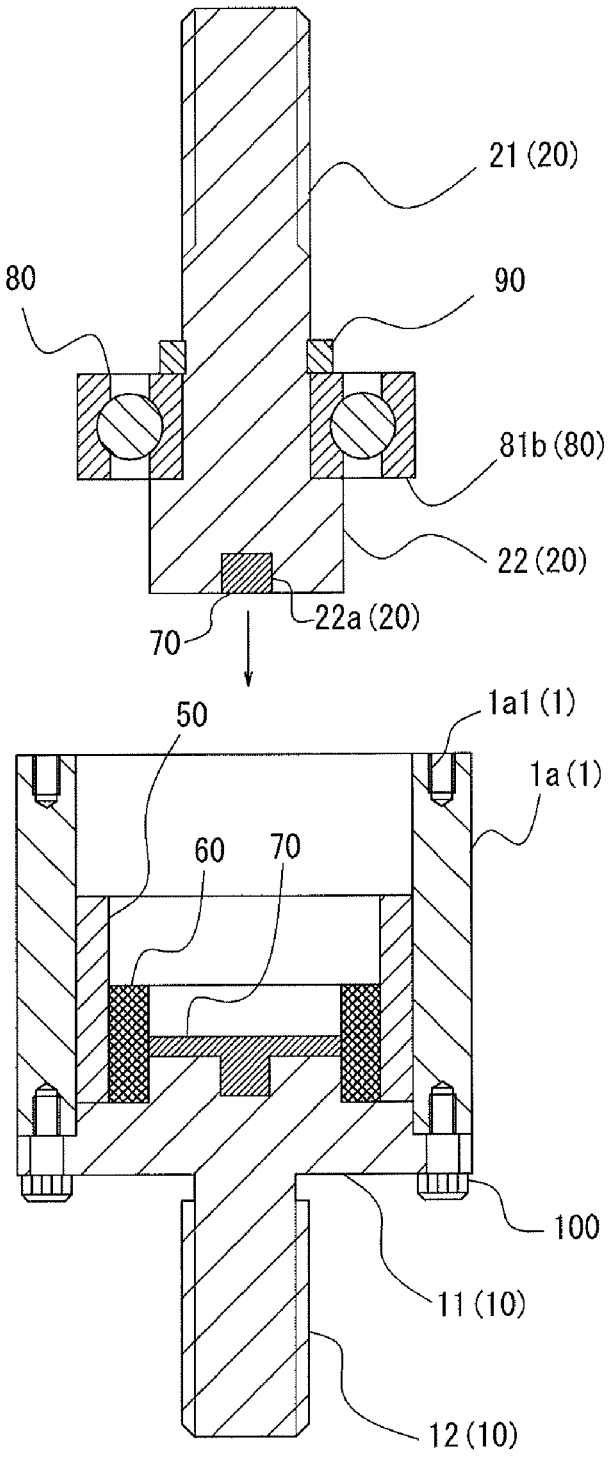
FIG. 9 is a schematic view used to describe the assembly process of the rotary connector according to the first embodiment of the invention.
Figure 10:
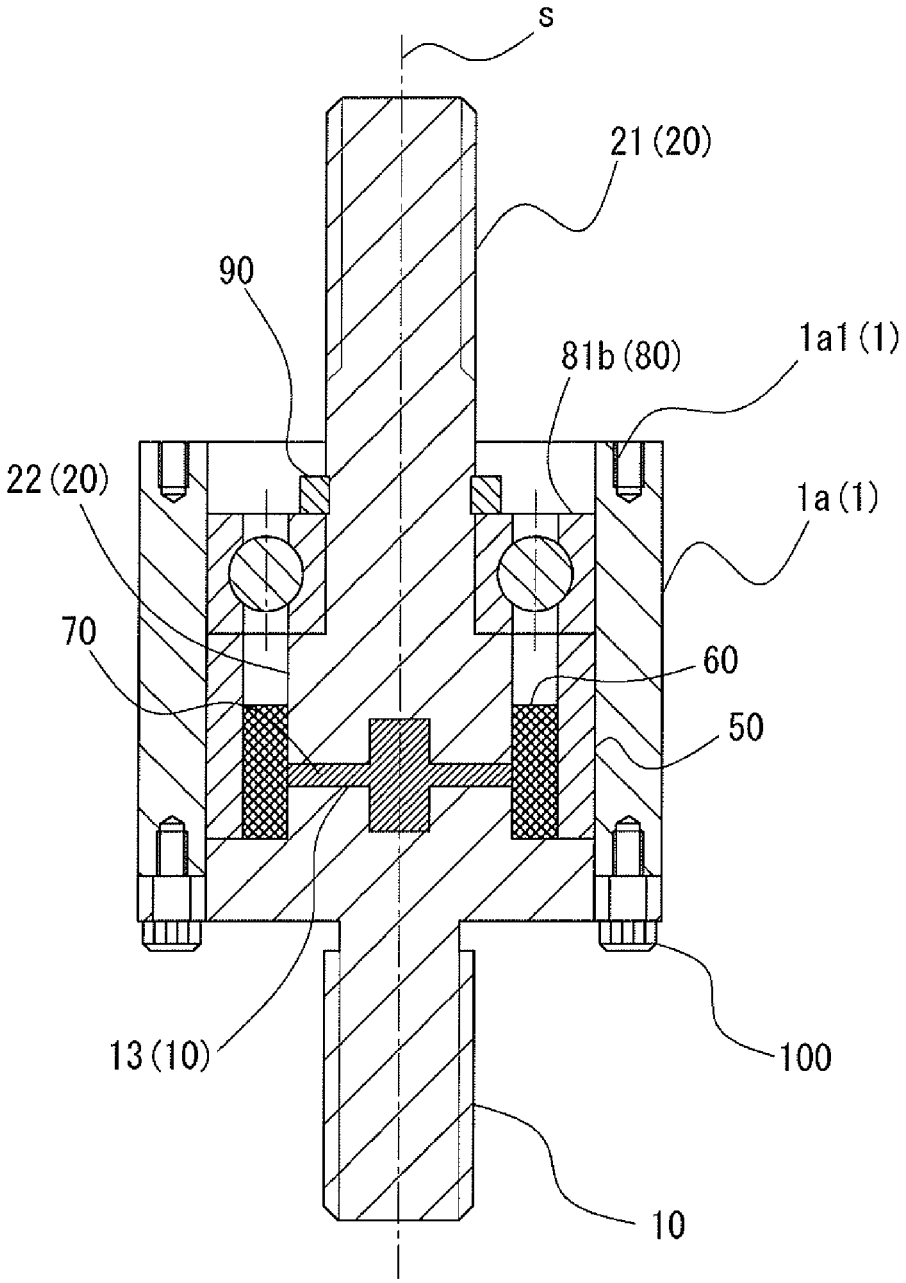
FIG. 10 is a schematic view used to describe the assembly process of the rotary connector according to the first embodiment of the invention.

The assembly process of the rotary connector W according to the first embodiment will be described below with reference to FIG. 1 and FIGS. 6 to 10. FIGS. 6 to 10 are schematic views used to describe the assembly process of the rotary connector according to the first embodiment of the invention. FIG. 6 illustrates the process for mounting the felt 60 attached to the cylindrical collar 50 into the main body unit 1*a* of the external shell case 1 to which the fixed side electrode 10 has been attached. FIG. 7 illustrates the state in which the felt 60 attached to the cylindrical collar 50 is disposed in the main body unit 1*a* of the external shell case 1 to which the fixed side electrode 10 has been mounted. In addition, FIG. 8 illustrates the state in which the intermediate product illustrated in FIG. 7 is filled with the liquid metal 70. FIG. 9 illustrates the process for mounting the rotating side electrode 20 rotatably supported by the ball bearing 80 to the intermediate product illustrated in FIG. 8. In addition, FIG. 10 illustrates the state in which the rotating side electrode 20 rotatably supported by the ball bearing 80 has been attached to the intermediate product illustrated in FIG. 8.

Specifically, first, the end part of the main body unit 1*a* of the external shell case 1 is placed in the step part 11*a* formed at the outer peripheral edge of the base part 11 of the fixed side electrode 10, and the screw hole 11*a*1 of the base part 11 is aligned with the screw hole 1*a*1 of the main body unit 1*a*. In addition, the screw 100 is inserted into and screwed with the screw hole 11*a*1 and the screw hole 1*a*1 aligned with each other. This mounts the fixed side electrode 10 to the main body unit 1*a* of the external shell case 1, as illustrated in FIG. 6.

Next, the inner peripheral surface of the felt 60 supported by the cylindrical collar 50 is brought into contact with the outer peripheral surface of the convex part 13 of the fixed side electrode 10 mounted to the external shell case 1 and the outer peripheral surface of the cylindrical collar 50 is fitted to and fixed to the inner peripheral surface of the main body unit 1*a* of the external shell case 1. At this time, one end parts (lower end parts in the drawing) of the cylindrical collar 50 and the felt 60 are placed on the base part 11 of the fixed side electrode 10. As illustrated in FIG. 7, this disposes the felt 60 supported by the cylindrical collar 50 in the external shell case 1 (main body unit 1*a*) to which the fixed side electrode 10 has been mounted. In the first embodiment, the upper end part of the felt 60 is disposed above the upper end surface of the convex part 13 of the fixed side electrode 10.

As pre-processing before the felt 60 is mounted to the convex part 13 of the fixed side electrode 10, the felt 60 is impregnated with multivalent alcohol (or high viscosity oil).

Next, the substantially cup-shaped region (void) formed by one end surface (upper end surface) of the convex part 13 of the fixed side electrode 10 and the inner peripheral surface of the felt 60 extending upward from one end surface of the convex part 13 is filled with the liquid metal 70. As illustrated in FIG. 8, this enters the state in which the substantially cup-shaped region (void) described above is filled with the liquid metal 70.

In the first embodiment, alloy of gallium, indium, and tin is used as the liquid metal 70.

Next, the rotating side electrode 20 is attached to the intermediate product in the state illustrated in FIG. 8. Specifically, as illustrated in FIG. 9, the concave part 22*a* of the large-diameter part 22 of the rotating side electrode 20 rotatably supported by the ball bearing 80 is filled with the liquid metal 70, the outer peripheral surface of the large-diameter part 22 of the rotating side electrode 20 is inserted onto the inner peripheral surface of the felt 60 extending upward from the one end surface of the convex part 13 of the fixed side electrode 10 so that the outer peripheral surface of the large-diameter part 22 makes contact with the inner peripheral surface of the felt 60 and the end part (lower end part in the drawing) of the outer ring 81*b* of the ball bearing 80 is placed on one surface (upper surface in the drawing) of the cylindrical collar 50.

As illustrated in FIG. 10, this process causes the end surface of the convex part 13 of the fixed side electrode 10 and the end surface of the large-diameter part 22 of the rotating side electrode 20 to face each other spaced apart. In addition, this process causes the region formed by the end surface of the convex part 13 of the fixed side electrode 10, the end surface of the large-diameter part 22 of the rotating side electrode 20, and the inner peripheral surface of the felt 60 to be filled with the liquid metal 70.

Finally, the upper lid 1*b* is mounted on the intermediate product in the state illustrated in FIG. 10 to complete the rotary connector W illustrated in FIG. 1.

Specifically, the through hole 1*b*1 of the upper lid 1*b* is inserted onto the terminal part 21 of the rotating side electrode 20 in the state illustrated in FIG. 10 and the upper lid 1*b* is placed on the upper end of the main body unit 1*a*. When the upper lid 1*b* is placed on the upper end of the main body unit 1*a*, the annular convex part 1*b*3 formed on the lower surface of the upper lid 1*b* is placed on the upper end part of the outer ring 81*b* of the ball bearing 80.

When the screw hole 1*a*1 of the main body unit 1*a* is aligned with the screw hole 1*b*2 of the upper lid 1*b* and the screw 100 is inserted into and screwed with the screw hole 1*a*1 and the screw hole 1*b*2, the ball bearing 80 supporting the rotating side electrode 20 is held by the annular convex part 1*b*3 of the upper lid 1*b* and the cylindrical collar 50 fitted into the main body unit 1*a*. This causes the rotating side electrode 20 to be rotatably supported by the external shell case 1 via the ball bearing 80 and the cylindrical collar 50.

The rotary connector W assembled as described above has a fixed side mechanism (not illustrated) connected to the fixed side electrode 10 and a rotating side mechanism (not illustrated) connected to the rotating side electrode 20. In the rotary connector W, the fixed side electrode 10 and the rotating side electrode 20 are electrically connected to each other via the liquid metal 70, and the rotating side mechanism (not illustrated) connected to the rotating side electrode 20 causes the rotating side electrode 20 to rotate about a rotational shaft s. When the rotating side electrode 20 rotates, the inner ring 81*a* of the ball bearing 80 rotates together with the rotating side electrode 20.

In addition, in the first embodiment, the felt 60 in contact with the rotating side electrode 20 is supported so as to be fixed to the inner peripheral surface of the cylindrical collar 50 fixed to the inner peripheral surface of the main body unit 1*a* of the external shell case 1. Therefore, the felt 60 and the cylindrical collar 50 do not rotate even when the rotating side electrode 20 rotates.

As described above, since the fixed side electrode 10 does not directly make contact with the rotating side electrode 20 in the rotary connector W according to the first embodiment and these electrodes are electrically connected to each other via the liquid metal 70, friction or wear between components is less, thereby obtaining working effects of significantly reducing the frequency at which consumable parts are replaced.

In addition, since both electrodes are electrically connected to each other via the liquid metal 70 in the rotary connector W according to the first embodiment, micro gaps or the like formed in the metal ring surface do not make the sliding of a brush unstable unlike the slip ring of the prior art. Accordingly, in the first embodiment, the reliability of conductivity is improved and occurrence of signal error is prevented as compared with the prior art described above.

In addition, in the rotary connector W according to the first embodiment, the felt 60 forming the region to be filled with the liquid metal 70 is impregnated with multivalent alcohol or high viscosity oil. This structure prevents the oxidation of the liquid metal 70 that is easily oxidized by air and achieves stable conductivity between both electrodes.

Figure 11:
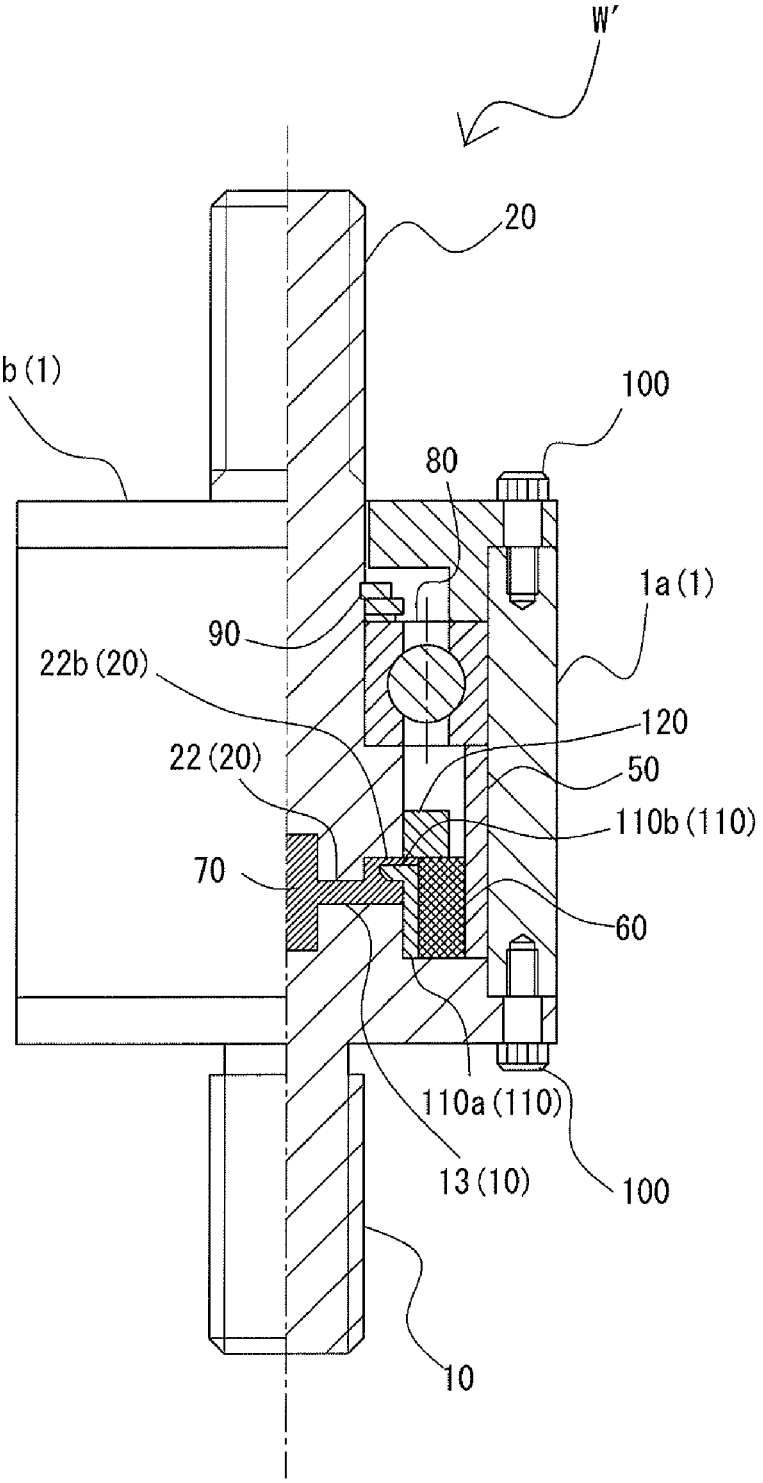
FIG. 11 is a schematic view used to describe the entire structure of a rotary connector according to a second embodiment of the invention.
Figure 12:
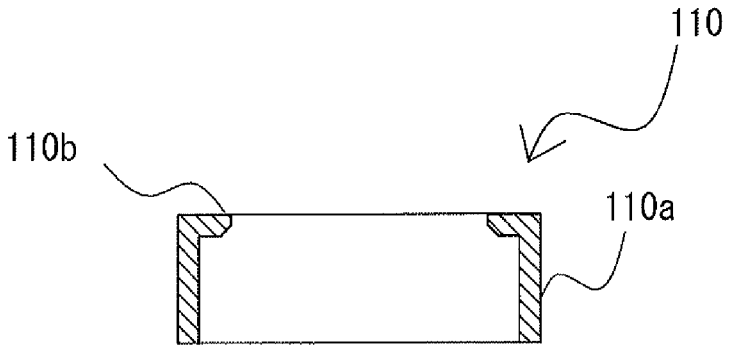
FIG. 12 is a schematic view illustrating a cross section of a fluorocarbon resin ring to be mounted to a fixed side electrode of the rotary connector according to the second embodiment of the invention.

Next, the structure of a rotary connector W' according to the second embodiment of the invention will be described with reference to FIGS. 11 and 12. FIG. 11 is a schematic view used to describe the entire structure of the rotary connector according to the second embodiment of the invention. In addition, FIG. 12 is a schematic view illustrating the cross section of the fluorocarbon resin ring to be attached to the fixed side electrode of the rotary connector according to the second embodiment of the invention.

The rotary connector W' according to the second embodiment is obtained by modifying part of the structure of the rotary connector W according to the first embodiment. Therefore, descriptions are given below focusing on the differences with the first embodiment and the structure identical to that of the first embodiment and the structure equivalent to that of the first embodiment are given the same reference numerals to simplify (or omit) descriptions.

The rotary connector W' according to the second embodiment includes the external shell case 1, the rod-shaped rotating side electrode 20 rotatably supported by the external shell case 1, the fixed side electrode 10 supported by the external shell case 1 so as to face the rotating side electrode 20, a fluorocarbon resin ring (first fluorocarbon resin ring) 110 fitted onto and fixed to the outer peripheral surface close to one end part of the fixed side electrode 10, a fluorocarbon resin ring (second fluorocarbon resin ring) 120 fitted onto and fixed to the outer peripheral surface close to one end part of the rotating side electrode 20, and the felt 60 fitted onto and fixed to the outer peripheral surface of the fluorocarbon resin ring 110. In addition, the fixed side electrode 10 and the rotating side electrode 20 are disposed so that the end surfaces of one end parts of the electrodes face each other spaced apart to form a clearance therebetween.

In addition, in the fluorocarbon resin ring 110 fitted onto and fixed to the outer peripheral surface of the fixed side electrode 10, one end part (upper end part in the drawing) thereof projects closer to the rotating side electrode 20 (upper side in the drawing) than one end part (upper end part in the drawing) of the fixed side electrode 10. One end part of the fluorocarbon resin ring 110 is spaced apart from one end part of the rotating side electrode 20 and one end part (lower end part in the drawing) of the fluorocarbon resin ring 120.

In addition, the felt 60 is impregnated with multivalent alcohol (or high viscosity oil) and one end part (upper end part in the drawing) thereof extends closer to the rotating side electrode 20 (upper side in the drawing) than one end part (upper end part in the drawing) of the fluorocarbon resin ring 110 so as to make slidable contact with one end part (lower end part in the drawing) of the fluorocarbon resin ring 120 fitted onto the rotating side electrode 20. The felt 60 is attached to the inner peripheral surface of the cylindrical collar 50 and is supported by the cylindrical collar 50.

In addition, in the second embodiment, a closed region (void) is formed by one end part of the fixed side electrode 10, one end part of the rotating side electrode 20, one end part of the fluorocarbon resin ring 120, and the inner peripheral surface of the felt 60 and this region is filled with the liquid metal 70 to electrically connect both electrodes.

The part of the structure of the second embodiment that differs from that of the first embodiment will be described.

First, the fluorocarbon resin ring 110 will be described.

As illustrated in FIG. 12, the fluorocarbon resin ring 110 is a component to be fitted onto and fixed to the convex part 13 of the fixed side electrode 10 and includes a cylindrical part 110*a* of a hollow cylinder having pierced ends and a collar-shaped (annular in plan view) folded part 110*b* extending radially inward (substantially at a right angle toward the center of the cylindrical part 110) from the opening edge of the one end (upper side in the drawing) of the cylindrical part 110*a* (shape having an opening in a bottom part shaped like a bottom cup).

In addition, the inner diameter of the cylindrical part 110*a* is slightly larger than the diameter of the convex part 13 of the fixed side electrode 10 and the inner peripheral surface thereof is fitted and fixed to the outer peripheral surface of the convex part 13 of the fixed side electrode 10.

In addition, as illustrated in FIG. 11, when the inner peripheral surface of the cylindrical part 110*a* is fitted and fixed to the outer peripheral surface of the convex part 13 of the fixed side electrode 10, one end part (upper end part in the drawing) thereof projects closer to the rotating side electrode 20 (upper side in the drawing) than one end part (upper end part in the drawing) of the convex part 13 of the fixed side electrode 10 and the folded part 110*b* is disposed in the region formed by an annular concave part 22*b* (described later) provided in one end part of the rotating side electrode 20.

Next, the structure of the rotating side electrode 20 will be described.

As illustrated in FIG. 11, in the rotating side electrode 20 according to the second embodiment, the annular concave part 22*b* recessed like an L-shape (annular in plan view) is formed in the outer peripheral edge of one end surface of the large-diameter part 22. This annular concave part 22*b* provides the area in which the folded part 110*b* of the fluorocarbon resin ring 110 is disposed.

Next, the structure of the fluorocarbon resin ring 120 will be described.

The fluorocarbon resin ring 120 is a component fitted onto and fixed to the large-diameter part 22 of the rotating side electrode 20 and is formed in a ring having a rectangular cross section. The inner diameter of this fluorocarbon resin ring 120 is slightly larger than the diameter of the large-diameter part 22 of the rotating side electrode 20 and the inner peripheral surface thereof is fitted and fixed to the outer peripheral surface of the large-diameter part 22 of the rotating side electrode 20. The fluorocarbon resin ring 120 is mounted to the rotating side electrode 22 so that one end surface (lower surface in the drawing) thereof is flush with the annular concave part 22*b* of the rotating side electrode 22.

Next, the structures of the felt 60 and the cylindrical collar 50 will be described.

The felt 60 and the cylindrical collar 50 are formed in hollow cylinders having pierced ends as in the first embodiment. The felt 60 according to the second embodiment has a larger inner diameter and a smaller height than in the first embodiment. In addition, the cylindrical collar 50 according to the second embodiment has a larger inner diameter and a smaller wall thickness than in the first embodiment.

The height of the felt 60 is larger than that of the fluorocarbon resin ring 110. When the felt 60 is fitted onto the fluorocarbon resin ring 110 mounted to the outer peripheral surface of the fixed side electrode 10, one end part (upper end part in the drawing) thereof makes slidable contact with one end part (lower end part in the drawing) of the fluorocarbon resin ring 120 fitted onto the rotating side electrode 20.

In the rotary connector W' configured as described above, as in the first embodiment, the fixed side electrode 10 and the rotating side electrode 20 are electrically connected to each other via the liquid metal 70 and a rotating side mechanism (not illustrated) connected to the rotating side electrode 20 causes the rotating side electrode 20 to rotate about the rotational shaft. When the rotating side electrode 20 rotates, the inner ring 81*a* of the ball bearing 80 and the fluorocarbon resin ring 120 rotate together with the rotating side electrode 20. In addition, when the fluorocarbon resin ring 120 rotates together with the rotating side electrode 20, one end part (lower end part in the drawing) thereof makes slidable contact with one end part (upper end part in the drawing) of the felt 60.

As described above, since both electrodes are electrically connected to each other via the liquid metal 70 in the rotary connector W' according to the second embodiment, the same working effects as in the above rotary connector W according to the first embodiment can be obtained.

In addition, the second embodiment is provided with the fluorocarbon resin ring 110 fitted onto the outer peripheral surface of the fixed side electrode 10. This fluorocarbon resin ring 110 has one end part (upper end part in the drawing) projecting closer to the rotating side electrode 20 (upper side in the drawing) than one end part (upper end part in the drawing) of the convex part 13 of the fixed side electrode 10 and the folded part 110*b* is disposed in the region formed by the annular concave part 22*b* provided in one end part of the rotating side electrode 20. Such a structure is adopted because of the following reasons.

Specifically, when the rotating side electrode 20 rotates, the liquid metal 70 moves toward the outer periphery of the rotating side electrode 20 (and the fixed side electrode 10) and is unevenly distributed to the outer periphery of the rotating side electrode 20 (and the fixed side electrode 10) due to effects of the centrifugal force of the rotation. Therefore, in the second embodiment, the fluorocarbon resin ring 110 projecting closer to the rotating side electrode 20 than one end part of the convex part 13 is mounted to the outer peripheral surface of the convex part 13 of the fixed side electrode 10 to prevent the liquid metal 70 from moving and being unevenly distributed to the outer periphery of the rotating side electrode 20 (and the fixed side electrode 10) due to the centrifugal force, thereby preventing reduction in the stability of electric connection.

One end of the fluorocarbon resin ring 110 is provided with the folded part 110*b* bent toward the center of the rotating side electrode 20 (and the fixed side electrode 10). This folded part 110*b* effectively prevents the liquid metal 70 from moving toward the felt 60.

In addition, in the second embodiment, the fluorocarbon resin ring 120 is fitted onto the outer peripheral surface of the large-diameter part 22 of the rotating side electrode 20. In addition, the felt 60 is fitted onto the outer peripheral surface of the fluorocarbon resin ring 110 so as not to make contact with the rotating side electrode 20 and one end part thereof makes slidable contact with one end part of the fluorocarbon resin ring 120 fitted onto the outer peripheral surface of the rotating side electrode 20.

In this structure, while the rotating side electrode 20 rotates, the felt 60 makes slidable contact with the fluorocarbon resin ring 120 rotating together with the rotating side electrode 20 without making contact with the rotating side electrode 20. That is, in the second embodiment, since the felt 60 does not make contact with the rotating side electrode 20 that is rotating and makes slidable contact with the fluorocarbon resin ring 120 having low abrasion, wear of the felt 60 is suppressed as compared with the first embodiment.

Figure 14:
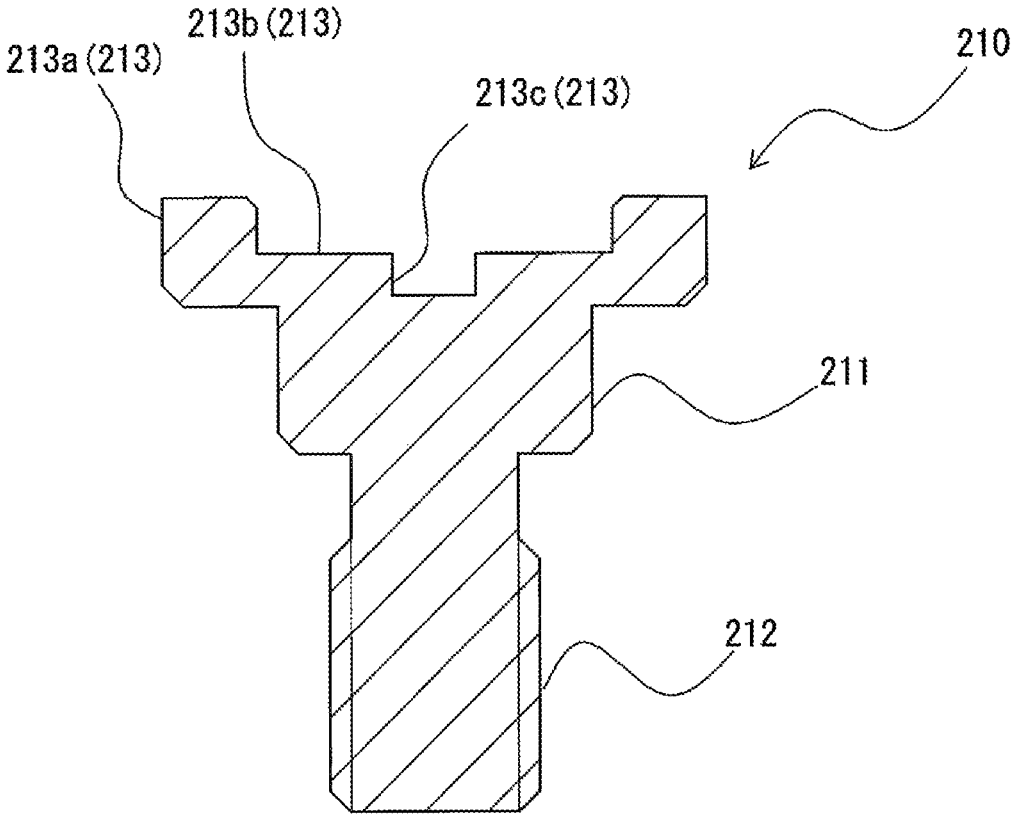
FIG. 14 is a schematic view illustrating a cross section of a fixed side electrode of the rotary connector according to the third embodiment of the invention.
Figure 15:
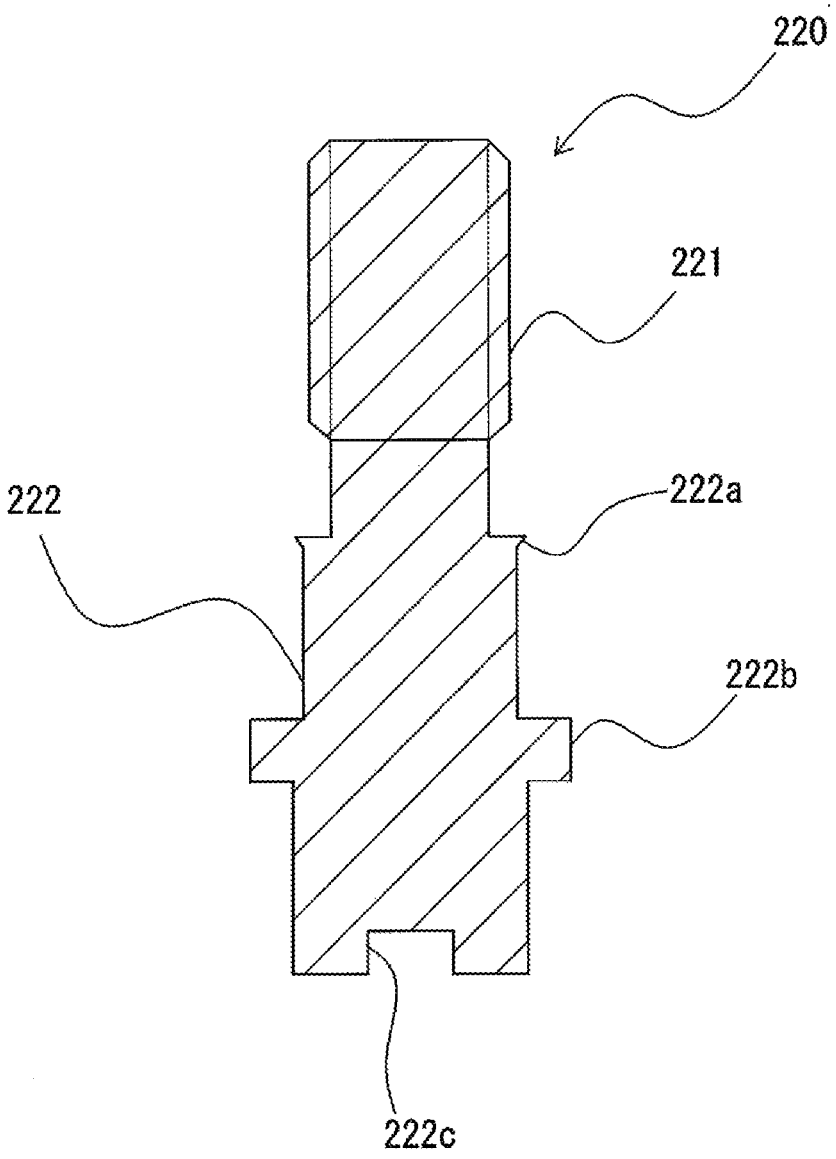
FIG. 15 is a schematic view illustrating a cross section of a rotating side electrode of the rotary connector according to the third embodiment of the invention.

Next, the structure of a rotary connector W" according to the third embodiment of the invention will be described with reference to FIGS. 13 to 15.

The rotary connector W" according to the third embodiment is obtained by modifying part of the structure of the rotary connectors W" according to the first and second embodiments. Therefore, descriptions are given below focusing on the differences with the first and second embodiments and the structure identical to that of the first and second embodiments and the structure equivalent to that of the first and second embodiments are given the same reference numerals to simplify (or omit) descriptions.

Specifically, for improvement of the productivity, press-fitting is used instead of screws to fix the fixed side electrode and crimping is used instead of screws to fix the rotating side electrode in the third embodiment. For this purpose, in the third embodiment, the shapes of the external shell case, the fixed side electrode, and the rotating side electrode are different from those of the first and second embodiments.

In addition, in the third embodiment, for improvement of the sealability of liquid metal and multivalent alcohol, the shapes and installation positions of the fluorocarbon resin rings (first fluorocarbon resin ring and second fluorocarbon resin ring) and the felt are different from those of the second embodiment.

Figure 13:
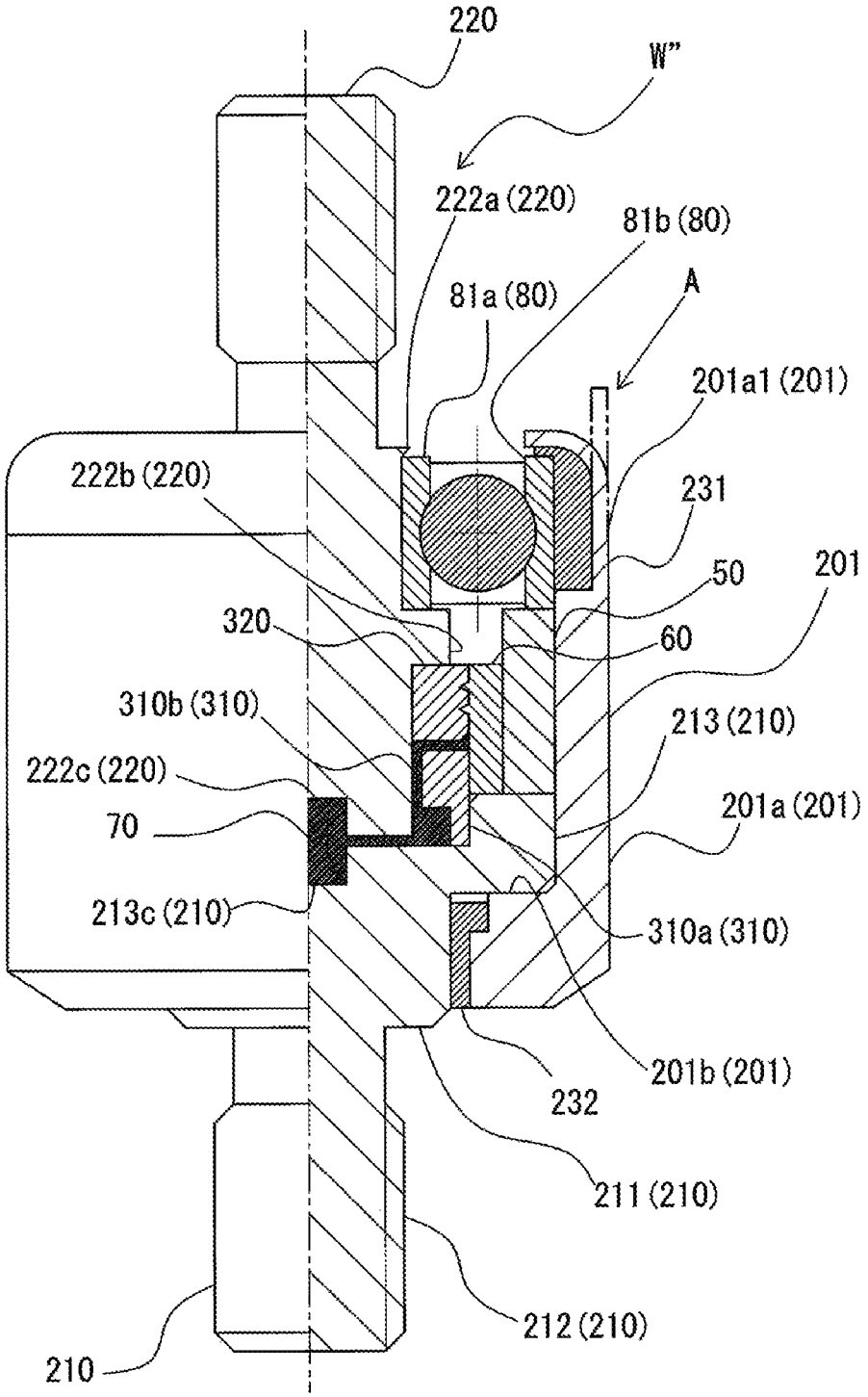
FIG. 13 is a schematic view used to describe the entire structure of a rotary connector according to a third embodiment of the invention.

FIG. 13 is a schematic view used to describe the entire structure of the rotary connector according to the third embodiment of the invention. In addition, FIG. 14 is a schematic view illustrating a cross section of the fixed side electrode of the rotary connector according to the third embodiment of the invention. In addition, FIG. 15 is a schematic view illustrating a cross section of the rotating side electrode of the rotary connector according to the third embodiment of the invention.

As illustrated in FIG. 13, the rotary connector W" according to the third embodiment includes the external shell case 201, a rod-shaped rotating side electrode 220 rotatably supported by the external shell case 201, the fixed side electrode 210 supported by the external shell case 201 so as to face the rotating side electrode 220, a fluorocarbon resin ring (first fluorocarbon resin ring) 310 mounted to the one end part of the fixed side electrode 210, a fluorocarbon resin ring (second fluorocarbon resin ring) 320 fitted onto and fixed to the outer peripheral side surface close to one end part of the rotating side electrode 220, and a cylindrical felt (liquid impregnated member) 60 provided between the fluorocarbon resin ring 310 and the fluorocarbon resin ring 320 so as to surround the outer peripheral surfaces of the fluorocarbon resin ring 310 and the fluorocarbon resin ring 320. In addition, the felt 60 is attached to the inner side surface of the cylindrical collar 50 fitted into and fixed to the inner side surface of the external shell case 201 and is supported by the cylindrical collar 50.

The outer peripheral side surface of the fluorocarbon resin ring (second fluorocarbon resin ring) 320 makes slidable contact with the inner peripheral side surface of the felt 60.

In addition, the fixed side electrode 210 and the rotating side electrode 220 are disposed so that one end parts of the electrodes face each other spaced apart to form a clearance therebetween, as in the first embodiment. In addition, the fluorocarbon resin ring 310 and the fluorocarbon resin ring 320 are disposed so that one end parts of the rings face each other spaced apart to form a clearance therebetween.

In the third embodiment, a closed region (void) is formed by one end part (upper end part) of the fixed side electrode 210, one end part (lower end part) of the rotating side electrode 220, the inner peripheral side surface and one end part (upper end surface) of the fluorocarbon resin ring 310, one end part (lower end surface) of the fluorocarbon resin ring 320, and the inner peripheral side surface of the felt 60, this region is filled with the liquid metal 70, and both electrodes are electrically connected to each other. In addition, the felt 60 is impregnated with multivalent alcohol or high viscosity oil as in the first embodiment.

Of the components according to the third embodiment, the external shell case 201, the fixed side electrode 210, and the rotating side electrode 220 that have been changed from those in the first and second embodiments and the first fluorocarbon resin ring 310, the second fluorocarbon resin ring 320, and the cylindrical collar 50, and the felt 60 that have been changed from those in the second embodiment will be described below.

First, the external shell case 201 according to the third embodiment will be described.

The external shell case 201 has a main body unit 201*a* formed in a substantially hollow cylinder having pierced ends, and a thin-walled part 201*a*1 to which a substantially annular bearing fixing resin 231 has been attached is formed on the inner peripheral side surface of one end side (upper end side) of the main body unit 201*a*. The outer peripheral side surface of the outer ring 81*b* of the bearing 80 makes contact with the inner peripheral side surface of the bearing fixing resin 231. The external shell case 201 is press-fitted and fixed to the bearing 80 supporting the rotating side electrode 220 by bending and crimping the upper end side (section A in the drawing) of the thin-walled part 201*a* toward the upper end side of the bearing 80.

In addition, a brim part 201*b* projecting radially inward is formed at the lower end of the main body unit 201*a* of the external shell case 201. A substantially annular close contact resin 232 is attached to the inner peripheral side surface of the brim part 201*b*. The close contact resin 232 is a component having the function of improving the adhesion between the fixed side electrode 210 and the external shell case 201 and the inner peripheral side surface thereof makes contact with the outer peripheral side surface of a base part 211 of the fixed side electrode 210.

The fixed side electrode 210 is fixed to the external shell case 201 by press-fitting the large-diameter part 213 to the inner peripheral side surface of the main body unit 201*a* of the external shell case 201 so that the lower surface of a large-diameter part 213 makes contact with the upper surface of the brim part 201*b* of the external shell case 201.

Next, the fixed side electrode 210 according to the third embodiment will be described with reference to FIG. 14.

As illustrated in the drawing, the fixed side electrode 210 includes the substantially cylindrical base part 211, the large-diameter part 213 that is circular in plan view, increases in diameter from the base part 211, and extends vertically from one surface (upper surface in the drawing) of the base part 211 in one direction (upward in the drawing), and the substantially cylindrical terminal part 212 (terminal part 212 that reduces in diameter from the base part 211) that extends vertically from the other surface (lower surface in the drawing) of the base part 211 in the other direction (downward in the drawing). The fixed side electrode 210 is made of a conductive material such as metal. In addition, a fixed side mechanism (not illustrated) is electrically connected to the terminal part 212.

In addition, the large-diameter part 213 has a first annular part 213*a*, which is annular in plan view, on the outer peripheral side and a second annular part 213*b*, which is recessed annularly in plan view from the upper surface of the first annular part 213*a*, inside the first annular part 213*a*. In addition, a concave part 213*c*, which is recessed roundly in plan view from the upper surface of the second annular part 213*b*, is formed inside the second annular part 213*b* (the center of the large-diameter part 213 is the concave part 213*c*).

The large-diameter part 213 has an outer diameter so that the large-diameter part 213 can be press-fitted and fixed to the inner peripheral side surface of the main body unit 201*a* included in the external shell case 201. In addition, the first annular part 213*a* has a length in the radial direction so that the cylindrical collar 50 and the felt 60 can be placed.

Next the rotating side electrode 220 will be described with reference to FIG. 15.

As illustrated in the drawing, one side (upper side in the drawing) of the rotating side electrode 220 is a substantially cylindrical terminal part 221 and the other side (lower side in the drawing) is the large-diameter part 222 having a diameter larger than the terminal part 221. The rotating side electrode 220 is made of a conductive material such as metal. In addition, a rotating side mechanism (not illustrated) is electrically connected to the terminal part 221.

In addition, one end part (upper end part) of the large-diameter part 222 is provided with a first convex part 222*a* projecting radially outward along the peripheral direction of the outer peripheral side surface. In the position away from the first convex part 222*a* toward the other end (lower end) by a predetermined length, a second convex part 222*b* projecting radially outward along the peripheral direction of the outer peripheral side surface is formed.

The inner peripheral side surface of the inner ring 81*a* of the bearing 80 is fitted onto and fixed to the outer peripheral side surface part between the first convex part 222*a* and the second convex part 222*b*, thereby causing the rotating side electrode 220 to be rotatably supported by the ball bearing 80. In addition, a recessed concave part 222*c*, which is circular in plan view, is formed at the center of the other end part (lower end part) of the large-diameter part 222 and the concave part 222*c* is disposed so as to face the concave part 213*c* formed in the large-diameter part 213 of the fixed side electrode 210 (see FIG. 13). The concave part 222*c* and the concave part 213*c* are formed to have the same size and the same shape.

Next, the fluorocarbon resin rings 310 and 320 will be described with reference to FIG. 13.

The fluorocarbon resin ring (first fluorocarbon resin ring) 310 is a component mounted to one end part (upper end part) of the fixed side electrode 210 and has the structure (L-shaped in sectional view) including the cylindrical part 310*a* formed in a hollow cylinder having pierced ends and a folded part 310*b* that is annular in plan view and extends radially inward (substantially at a right angle toward the center of the cylindrical part 310*a*) from the opening edge of one end side (upper side in the drawing) of the cylindrical part 310*a*.

In addition, the outer diameter of the cylindrical part 310*a* is slightly smaller than the inner diameter of the first annular part 213*a* (see FIG. 14) forming the large-diameter part 213 of the fixed side electrode 210 so that the outer peripheral side surface thereof is fitted and fixed to the inner peripheral side surface of the first annular part 213*a*. (At this time, the lower end of the cylindrical part 310*a* is placed on the upper surface of a second annular part 210*b* (see FIG. 14) of the fixed side electrode 220).

In addition, the inner diameter of the fluorocarbon resin ring 310 is larger than the outer diameter of the large-diameter part 222 of the rotating side electrode 220, and one end part (upper end part) thereof extends upward by a predetermined length from the lower end part (one end part) of the rotating side electrode 220. In this structure, the inner peripheral side surface of the fluorocarbon resin ring 310 surrounds the clearance formed between one end parts of the fixed side electrode 210 and the rotating side electrode 220 and surrounds the outer peripheral side surface of the rotating side electrode 220 in a noncontact manner.

The fluorocarbon resin ring (second fluorocarbon resin ring) 320 is formed in an annular shape and one end part (lower end part) thereof is disposed so as to face one end part (upper end part) of the fluorocarbon resin ring 310 spaced apart to form a clearance therebetween. In addition, the inner diameter of the fluorocarbon resin ring 320 is slightly larger than the diameter of the large-diameter part 222 (see FIG. 15) of the rotating side electrode 220 and the inner peripheral side surface thereof is fitted onto and fixed to the outer peripheral side surface of the large-diameter part 222 of the rotating side electrode 220, and the other end part (upper end part) thereof makes contact with the lower surface of the second convex part 222*b* of the rotating side electrode 220.

In addition, the outer diameter of the fluorocarbon resin ring 320 is slightly smaller than the inner diameter of the felt 60 and the outer peripheral side surface thereof make slidable contact with the inner peripheral side surface of the felt 60.

In addition, the outer peripheral side surface of the fluorocarbon resin ring 320 is provided with concave parts (two concave parts) slidably fitted to convex parts (two convex parts in the example in the drawing) formed on the inner peripheral side surface of the felt 60. The concave parts are recessed radially inward like a V-shape in sectional view along the peripheral direction of the peripheral side surface of the fluorocarbon resin ring 320. The concave parts of the fluorocarbon resin ring 320 are provided so as to correspond to the convex parts formed on the inner peripheral side surface of the felt 60 and the number of the concave parts and the number of the above convex parts are designed as appropriate.

Next, the structures of the felt 60 and the cylindrical collar 50 according to the third embodiment will be described.

The felt 60 and the cylindrical collar 50 are formed in hollow cylinders having pierced ends as in the first embodiment. In the felt 60 according to the third embodiment, convex parts are formed on the inner peripheral side surface so as to be slidably fitted to the concave parts of the outer peripheral side surface of the fluorocarbon resin ring 320. The convex parts project radially inward like a V-shape in sectional view along the peripheral direction of the inner peripheral side surface of the felt 60.

The cylindrical collar 50 has a smaller inner diameter and a thicker thickness than in the first and second embodiments.

In the rotary connector W" configured as described above, as in the first embodiment, the fixed side electrode 210 and the rotating side electrode 220 are electrically connected to each other via the liquid metal 70 and either multivalent alcohol or high viscosity oil with which the felt 60 is impregnated and the rotating side electrode 220 rotates about the rotational shaft by the rotating side mechanism (not illustrated) connected to the rotating side electrode 220. When the rotating side electrode 220 rotates, the inner ring 81*a* of the ball bearing 80 rotates together with the rotating side electrode 220. In addition, when the rotating side electrode 220 rotates, the fluorocarbon resin ring 320 rotates together with the rotating side electrode 220. When the fluorocarbon resin ring 320 rotates together with the rotating side electrode 220, the outer peripheral side surface thereof makes slidable contact with the inner peripheral side surface of the felt 60.

As described above, since both electrodes are electrically connected to each other via the liquid metal 70 (and multivalent alcohol or high viscosity oil with which the felt 60 is impregnated) in the rotary connector W" according to the third embodiment, the same working effects as in the above rotary connector W according to the first embodiment can be obtained.

In addition, in the third embodiment, since the felt 60 does not make contact with the rotating side electrode 220 that is rotating and makes slidable contact with the fluorocarbon resin ring 320 having low abrasion as in the second embodiment, wear of the felt 60 is suppressed as compared with the first embodiment.

In addition, since the fixed side electrode 210 is fixed to an outer shell 201 by press-fitting and the rotating side electrode 220 is fixed to the outer shell 201 by crimping in the third embodiment and screws are not used unlike the first and second embodiments, the productivity is improved as compared with the first and second embodiments.

In addition, in the third embodiment, the above structure improves the sealability of the liquid metal 70 and either multivalent alcohol or high viscosity oil as compared with the first and second embodiments.

Specifically, in the first embodiment above, when the rotating side electrode 20 rotates, since much of the centrifugal force applied to the liquid metal 70 is received by the inner peripheral side surface of the felt 60, the liquid metal 70 and either multivalent alcohol or high viscosity oil may leak from the felt 60.

In the second embodiment, the first fluorocarbon resin ring 110 having an L-shaped cross section is disposed on the inner peripheral side surface of the felt 60 to reduce effects of the centrifugal force applied to the inner peripheral side surface of the felt 60.

However, in the second embodiment, since the sliding part (sliding surface) between the second fluorocarbon resin ring 120 and the felt 60 is disposed in the direction (radial linear direction toward radial outward direction) in which the centrifugal force is applied, the liquid metal 70 and either multivalent alcohol or high viscosity oil may leak from this sliding part.

Therefore, in the third embodiment, the first fluorocarbon resin ring 310 having an L-shaped cross section is disposed on the inner peripheral side surface of the felt 60 to reduce effects of the centrifugal force as in the second embodiment and the centrifugal force is received by the inner peripheral side surface of the felt 60 as in the first embodiment. That is, in the third embodiment, the first fluorocarbon resin ring 310 and the second fluorocarbon resin ring 320 are disposed so that the outer peripheral side surfaces of the rings are flush with each other and both the first fluorocarbon resin ring 310 and the second fluorocarbon resin ring 320 are surrounded by the inner peripheral side surface of the felt 60. In the third embodiment, the inner peripheral side surface of the felt 60 makes slidable contact with the outer peripheral surface of the second fluorocarbon resin ring 320 and the sliding part (sliding surface) between the felt 60 and the second fluorocarbon resin ring 320 is disposed orthogonally to the direction in which the centrifugal force is applied.

Since effects of the centrifugal force applied to the felt 60 can be reduced and the sliding part (sliding surface) between the second fluorocarbon resin ring 120 and the felt 60 is not disposed in the direction in which the centrifugal force is applied unlike the second embodiment in this structure, the sealability of the liquid metal 70 and either multivalent alcohol or high viscosity oil can be improved as compared with the first and second embodiments.

In addition, in the third embodiment, grooves (two concave parts) slidably fitted to convex parts (two convex parts) provided on the inner peripheral side surface of the felt 60 are formed in the outer peripheral side surface of the second fluorocarbon resin ring 320 in slidable contact with the inner peripheral side surface of the felt 60 to improve the sealability of the sliding part between the second fluorocarbon resin ring 320 and the felt 60.

The invention is not limited to the above embodiments (first embodiment, second embodiment, and third embodiment) and various modifications can be made within the spirit of the invention.

In the first and second embodiments (or the third embodiment), although the cylindrical felt 60 is provided to cover the clearance formed between the fixed side electrode 10 and the rotating side electrode 20 (or the fixed side electrode 210 and the rotating side electrode 220) and this felt 60 is impregnated with multivalent alcohol (or high viscosity oil), the invention is not limited particularly to the embodiments. Any cylindrical member that can cover the clearance formed between the fixed side electrode 10 and the rotating side electrode 20 (or the fixed side electrode 210 and the rotating side electrode 220) and retain multivalent alcohol (or high viscosity oil) is applicable to the invention. For example, porous cylindrical sponge (with open pores instead of closed pores) can be used instead of the felt 60.

REFERENCE SIGNS LIST

W: rotary connector
W': rotary connector
W": rotary connector
1: external shell case
1*a*: main body unit (external shell case)
1*a*1: screw hole (external shell case)
1*b*: upper lid (external shell case)
1*b*1: through hole (external shell case)
1*b*2: screw hole (external shell case)
1*b*3: annular convex part (external shell case)
10: fixed side electrode
11: base part (fixed side electrode)
11*a*: step part (fixed side electrode)
11*a*1: screw hole (fixed side electrode)
12: terminal part (fixed side electrode)
13: convex part (fixed side electrode)
13*a*: concave part (fixed side electrode)
20: rotating side electrode
21: terminal part (rotating side electrode)
22: large-diameter part (rotating side electrode)
22*a*: concave part (rotating side electrode)
22*b*: annular concave part (rotating side electrode)
23: step part (rotating side electrode)
50: cylindrical collar
60: felt
70: liquid metal
80: ball bearing
81*a*: inner ring (ball bearing)
81*b*: outer ring (ball bearing)
82: ball (ball bearing)
90: bearing fixing ring
100: screw
110: fluorocarbon resin ring
110*a*: cylindrical part (fluorocarbon resin ring)
110*b*: folded part (fluorocarbon resin ring)
120: fluorocarbon resin ring
201: external shell case
201*a*: main body unit (external shell case)
201*a*1: thin-walled part (external shell case)
201*b*: brim part (external shell case)
210: fixed side electrode
211: base part (fixed side electrode)
212: terminal part (fixed side electrode)
213: large-diameter part (fixed side electrode)
213*a*: first annular part (fixed side electrode)
213*b*: second annular part (fixed side electrode)
213*c*: concave part (fixed side electrode)
220: rotating side electrode
221: terminal part (rotating side electrode)
222: large-diameter part (rotating side electrode)
222*a*: first convex part (rotating side electrode)
222*b*: second convex part (rotating side electrode)
222*c*: concave part (rotating side electrode)
231: bearing fixing resin
232: close contact resin
310: fluorocarbon resin ring
310*a*: cylindrical part (fluorocarbon resin ring)
310*b*: folded part (fluorocarbon resin ring)
320: fluorocarbon resin ring

The invention claimed is:

1. A rotary connector comprising:

a rod-shaped rotating side electrode rotatably supported by an external shell case; and a fixed side electrode supported by the external shell case, wherein the rotating side electrode and the fixed side electrode are disposed so that one end parts of the electrodes face each other spaced apart to form a clearance therebetween, a cylindrical liquid impregnated member disposed so as to surround an outer peripheral surface close to the one end part of the fixed side electrode, the liquid impregnated member covering a clearance formed between the fixed side electrode and the rotating side electrode from outer peripheral sides of the fixed side electrode and the rotating side electrode, a conductive part is provided between the one end part of the rotating side electrode and the one end part of the fixed side electrode, the conductive part making electrical connection between the rotating side electrode and the fixed side electrode, and the conductive part includes liquid metal and either multivalent alcohol or high viscosity oil, wherein the conductive part includes the liquid metal filling a region formed by the one end part of the rotating side electrode, the one end part of the fixed side electrode, and an inner peripheral surface of the liquid impregnated member and either the multivalent alcohol or the high viscosity oil with which the liquid impregnated member is impregnated.

2. The rotary connector according to claim 1, further comprising:

a first fluorocarbon resin ring fitted onto the outer peripheral surface close to the one end part of the fixed side electrode; and a second fluorocarbon resin ring fitted onto an outer peripheral surface close to one end part of the rotating side electrode, wherein one end part of the first fluorocarbon resin ring projects closer to the rotating side electrode than the one end part of the fixed side electrode, and the liquid impregnated member is fitted onto an outer peripheral surface of the first fluorocarbon resin ring so as not to make contact with the rotating side electrode, the liquid impregnated member slidably making contact with one end part of the second fluorocarbon resin ring having the one end part being fitted onto the outer peripheral surface of the rotating side electrode.

3. A rotary connector including a rod-shaped rotating side electrode rotatably supported by an external shell case and a fixed side electrode supported by the external shell case, the rotary connector comprising:

a first fluorocarbon resin ring mounted to one end part of the fixed side electrode;

a second fluorocarbon resin ring fitted onto an outer peripheral surface close to one end part of the rotating side electrode; and a cylindrical liquid impregnated member disposed between the first fluorocarbon resin ring and the second fluorocarbon resin ring so as to surround an outer peripheral surface of the first fluorocarbon resin ring and an outer peripheral surface of the second fluorocarbon resin ring, wherein the rotating side electrode and the fixed side electrode are disposed so that the one end parts of the electrodes face each other spaced apart to form a clearance therebetween, the first fluorocarbon resin ring surrounds the clearance formed between the one end part of the fixed side electrode and the one end part of the rotating side electrode and surrounds an outer peripheral surface of the rotating side electrode so as not to make contact with the outer peripheral surface of the rotating side electrode, one end part of the second fluorocarbon resin ring and one end part of the first fluorocarbon resin ring face each other spaced apart to form a clearance therebetween, the liquid impregnated member is impregnated with multivalent alcohol or high viscosity oil, liquid metal fills a region formed by the one end part of the fixed side electrode, the one end part of the rotating side electrode, an inner peripheral surface and the one end part of the first fluorocarbon resin ring, the one end part of the second fluorocarbon resin ring, and an inner peripheral surface of the liquid impregnated member, and the liquid impregnated member slidably makes contact with the outer peripheral surface of the second fluorocarbon resin ring having an inner peripheral surface fitted onto the outer peripheral surface of the rotating side electrode.

4. The rotary connector according to claim 1, wherein the liquid metal is alloy of gallium, indium, and tin.

5. The rotary connector according to claim 2, wherein the liquid metal is alloy of gallium, indium, and tin.

* * * * *